United States Patent [19]

Norris

[11] 4,279,120

[45] Jul. 21, 1981

[54] SELF TWIST YARN AND METHOD AND APPARATUS FOR MAKING SUCH YARNS

[75] Inventor: Alan H. Norris, Rome, Ga.

[73] Assignee: WWG Industries, Inc., Rome, Ga.

[21] Appl. No.: 104,211

[22] Filed: Dec. 17, 1979

Related U.S. Application Data

[63] Continuation-in-part of Ser. No. 913,674, Jun. 8, 1978, abandoned, and a continuation of Ser. No. 916,567, Jun. 19, 1978, abandoned.

[51] Int. Cl.[3] ..... D02G 3/26; D02G 3/28; D01H 7/90; D01H 7/92

[52] U.S. Cl. ..... 57/204; 57/293

[58] Field of Search ..... 57/204, 205, 293, 294, 57/350

[56] References Cited

U.S. PATENT DOCUMENTS

| | | | |
|---|---|---|---|
| 3,225,533 | 12/1965 | Henshaw | 57/293 |
| 3,434,275 | 3/1969 | Backer et al. | 57/204 |
| 3,468,120 | 9/1969 | Hildebrand | 57/204 X |
| 3,545,194 | 12/1970 | Fish et al. | 57/293 |
| 3,775,955 | 12/1973 | Shah | 57/293 |
| 4,068,459 | 1/1978 | Movshovich et al. | 57/293 |
| 4,074,511 | 2/1978 | Chambley et al. | 57/293 |
| 4,170,103 | 10/1979 | Norris et al. | 57/293 |

*Primary Examiner*—John Petrakes

*Attorney, Agent, or Firm*—Beveridge, DeGrandi, Kline & Lunsford

[57] ABSTRACT

Self-twisting yarns are made by a system in which a strand twisting device is engaged with the strand and moves at strand speed to twist the oppositely-extending sections of the strand in opposite directions. The strand is brought together with another strand and released, enabling it to untwist and twist itself to the other strand. Various arrangements are disclosed for maximizing the distance between twist reversal nodes, for cabling plied yarns together, for strengthening the strands, for reducing the tensile stresses imposed on the strands and for producing unique products with non-uniform node spacing or unequal strand lengths between adjacent pairs of nodes.

60 Claims, 19 Drawing Figures

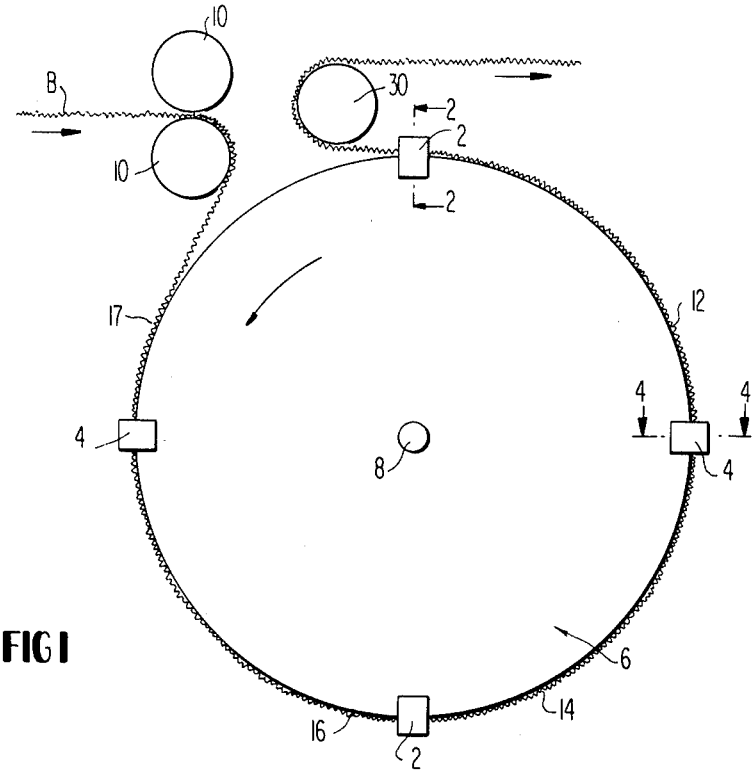
FIG 1
FIG 3
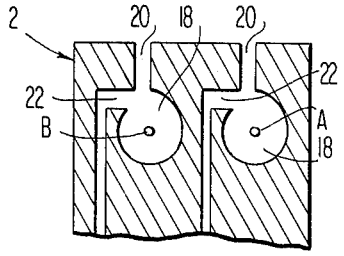
FIG 4
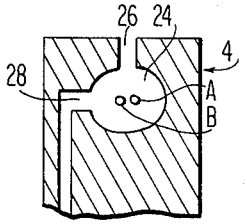
FIG 2
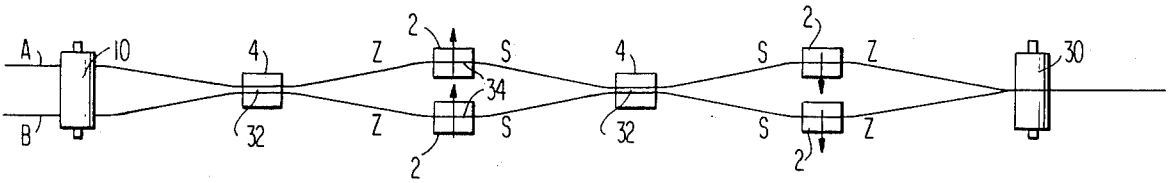
FIG 5
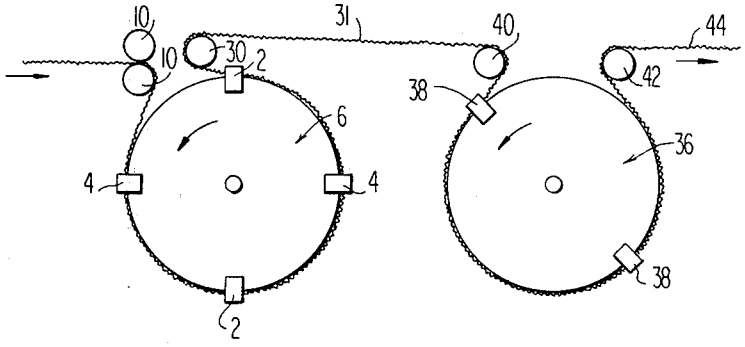
FIG 6
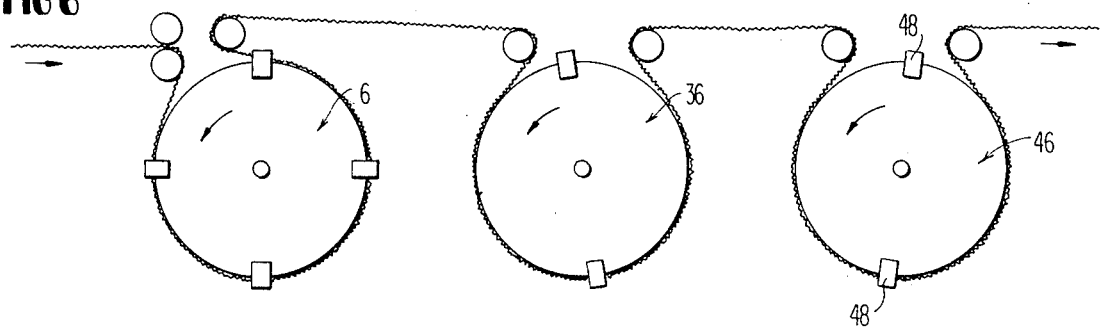

FIG 7
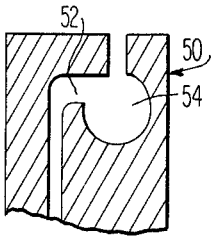
FIG 8
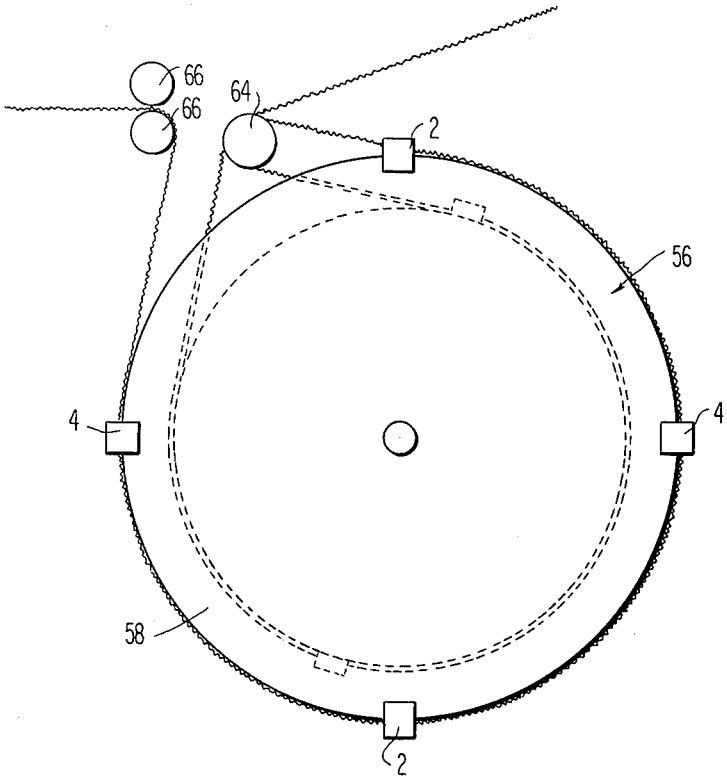
FIG 9
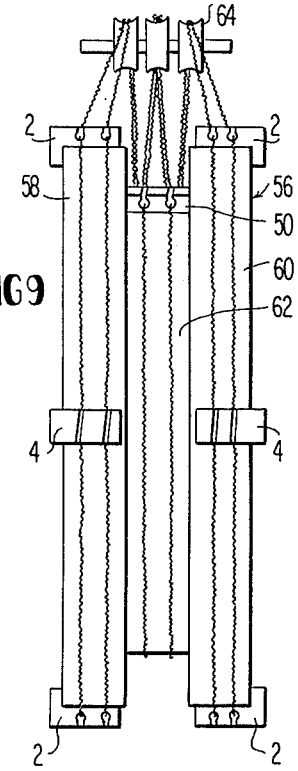
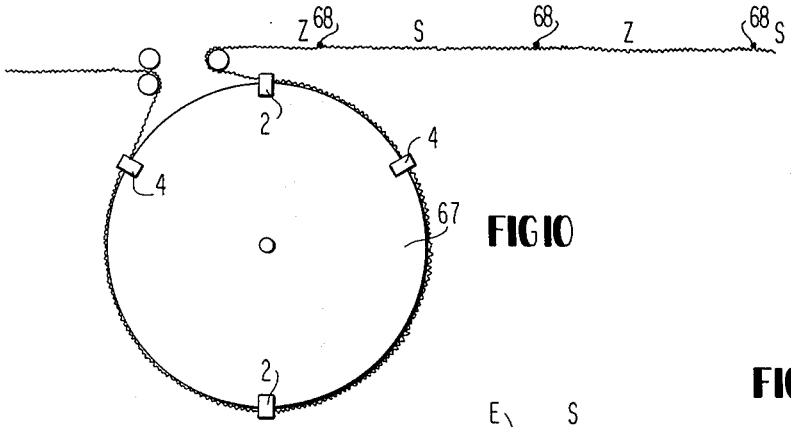
FIG 10
FIG 11
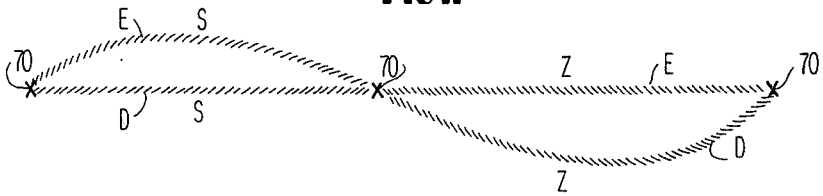
FIG 12
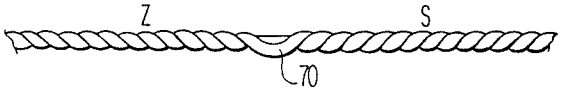

FIG 13
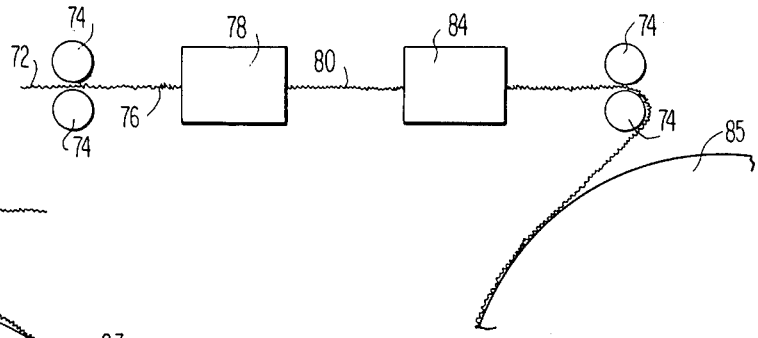
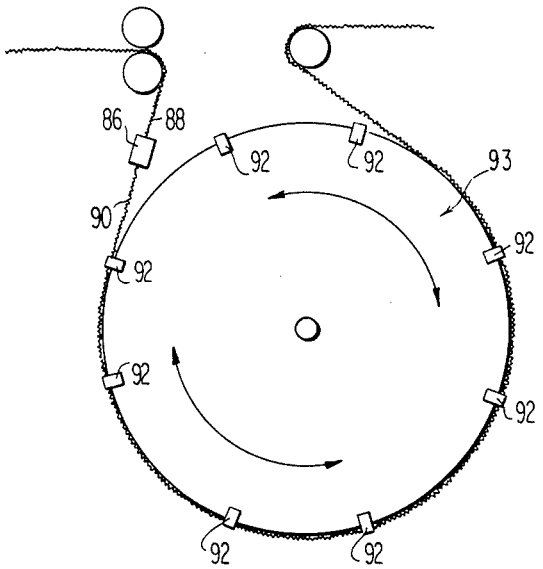
FIG 14
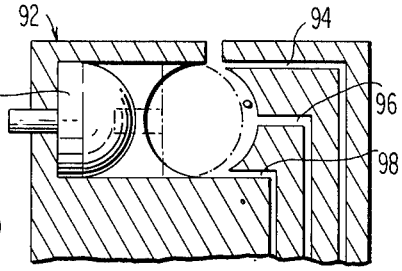
FIG 15
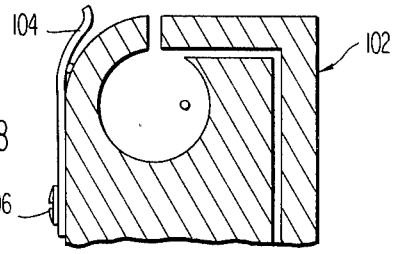
FIG 18
FIG 16
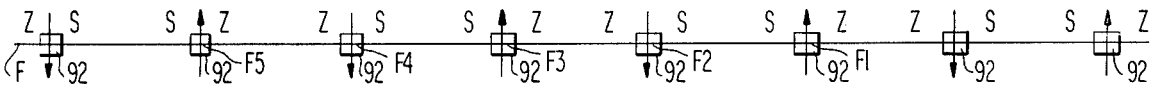
FIG 17
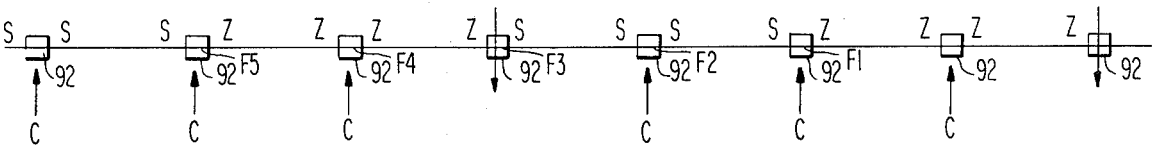
FIG 19
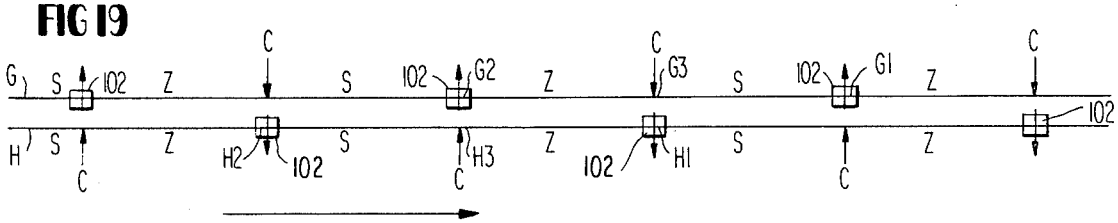

SELF TWIST YARN AND METHOD AND APPARATUS FOR MAKING SUCH YARNS

REFERENCE TO RELATED U.S. APPLICATIONS

This is a continuation-in-part of U.S. application Ser. No. 913,674 filed June 8, 1978, now abandoned, and a continuation of U.S. application Ser. No. 916,567 filed June 19, 1978, now abandoned, the disclosures of which are incorporated herein by reference.

BACKGROUND OF THE INVENTION

This invention relates to self-twist yarns and to improved methods and apparatuses for making such yarns.

Self-twisted yarns are yarns formed by twisting a strand to provide it with alternating sections of S-twist and Z-twist. The alternately twisted strand is unstable in the sense that, if set free, it would untwist to release the torque energy it received from the alternate twisting step. When two such strands are in parallel adjacent relationship with sections of corresponding twist disposed side-by-side, the strands are released to untwist and entwine about each other to form a self-twisted plied yarn. A plurality of such yarns may then be twisted together by a similar technique to form a "cable". For purposes of this description, the term "strand" is used in its generic sense to include, inter alia, singles strands, plied yarns and cabled yarns. The strand may be a continuous bundle of filaments, a continuous form of discontinuous filament, a drafted carded sliver which is untreated or pretreated to increase its tensile strength, continuous filaments produced by a tow treatment process or a combination of staple fibers and one or more continuous filaments.

Background information regarding self-twisted yarns is found in the book "Self-Twist Yarn" by D. E. Henshaw, Merrow Publishing Company Ltd., Watford, Herts, England, 1971. A partial listing of U.S. Pat. Nos. relating to this technology is as follows:

Re 27,717—Breen et al
4,074,511—Chambley & Norris
3,225,533—Henshaw
3,306,023—Henshaw et al
3,353,344—Clendening, Jr.
3,434,275—Backer et al
3,488,939—Walls
3,507,108—Yoshimura et al
3,537,251—Kimura et al
3,717,988—Walls
3,775,955—Shah
3,940,917—Strachan
4,055,039—Movshovich et al
4,068,459—Movshovich et al
4,084,400—Movshovich et al.

Some of the prior self-twisting systems are continuous in the sense that the strand is twisted and plied while moving at a constant velocity. It is believed that at least some continuous systems are suitable for industrial practice, one such system being shown in the Chambley and Norris U.S. Pat. No. 4,074,511 which uses stationary reversible fluid vortex devices for giving the strand an alternate twist, and a device which moves at strand velocity for joining the twist reversal points or "nodes" of adjacent strands before they are released to self-twist together. This requires precise timing and phasing controls which are complex, impose speed limitations on the system and may be extremely sensitive, especially when the operation of the twister must be phased to correspond to a preexisting twist condition in the strand being processed.

Prior self-twist systems raise potential problems with respect to twist distribution and the frequency of the twist reversal nodes. Regarding twist distribution, there is a tendency for twist to back up behind the reversible twister so that when the twister direction is changed, a surge of opposite twist is released which must be leveled and redistributed before a satisfactory product may be made by self-twisting. This problem is addressed in the Chambley et al patent listed above of which I am a co-inventor. With respect to the frequency of the nodes, it should be mentioned that the nodes present a visual discontinuity in the yarn since they are substantially without twist. It is therefore desirable to have the twist reversal nodes spaced as far apart as possible. Existing systems limit the distance between nodes to the practical distance along which twist can be propagated from a twist insertion location. Twice this distance is attainable according to the present invention.

SUMMARY OF THE INVENTION

This invention provides an uncomplicated but effective system for producing self-twisted yarn without the previously-mentioned disadvantages of the prior art. Various disclosed embodiments possess the advantages of effectiveness, relative simplicity, avoidance of reversible twisters and their attendant complications and the ability to produce unique products in which the node-to-node spacing may be longer than heretofore, and may be non-uniform. The strands twisted together between any two pair of nodes may be of unequal length.

According to a basic principle of the invention, a strand twisting device is moved concurrently with and in operative engagement with a longitudinally moving strand to rotate the strand and provide it with opposite twists on opposite sides of the twisting device. The alternately twisted strand is brought together with a second strand and released so it will untwist and become twisted to the second strand to form a self-twisted yarn. Two such twisting devices may engage the strand at spaced locations and operate in opposite directions so that the strand will have a unidirectional twist throughout the length between the twisting devices. The strand may be held against rotation between pairs of twisters by joining it to the adjacent strand or by engaging it with a strand clamping device.

The invention may be performed by three successively-arranged twisters which move concurrently with the strand, i.e. move with the strand substantially at strand speed. The intermediate twister is operated in an opposite direction from the leading and trailing twisters so the strand will be twisted in one direction between the leading and intermediate twisters and twisted in an opposite direction between the intermediate and trailing twisters whereby the length of a unidirectional twist zone is maximized. The twisters may be unequally spaced from each other or from intermediate clamping devices to provide a length of strand twisted in one direction which is different from the length of strand twisted in the opposite direction.

The invention also envisions a set of five twisting devices movable with the strand and engageable therewith. During an initial phase, the first and fifth twisters are operated in one direction while the second and fourth twisters are operated in an opposite direction. The strand is then held against rotation at the first, second, fourth and fifth locations while the third strand twisting device operates in the opposite direction so the strand will have one direction of twist extending from the first to the third location and an opposite direction of twist between the third and fifth locations.

The invention may be practiced by engaging the strand with a twisting device, a holding device, and a joining device, all of which move concurrently with and engage the strand. These devices preferably move in concentric or spaced apart circular paths. The holding device holds the strand against rotation at its location and the joining device joins the strand to another strand to provide a node connection as is known in the art. The joining device may be operated to produce fluid turbulence to entangle together the fibers of the strand therewithin.

The invention also contemplates the structure and use of successively arranged units for initially forming a self-twisted plied yarn from singles yarns and then forming the plied yarns into a cabled yarn by a self-twisting procedure.

Preferably, the twisting devices and joining devices are fluid operated and arranged so that the strand and the twisting or joining devices move laterally relative to each other until the strand is operatively engaged in a bore of the devices.

Various embodiments of the invention are especially adapted to process strands which have very little tensile strength, such strands being exemplified by strands formed of short staple fibers. These embodiments either strengthen the strand or minimize the unsupported lengths thereof which are subjected to tensile forces.

BRIEF DESCRIPTION OF THE DRAWINGS

FIG. 1 is a diagrammatic view of a system constructed and operated according to the invention.

FIG. 2 is a schematic illustration of the system of FIG. 1.

FIGS. 3 and 4 are transverse sectional views, respectively, of strand twisting devices and strand joining devices used in the system of FIGS. 1 and 2.

FIG. 5 is a modified system, similar to FIG. 1, but provided with means for increasing the ply twist in the yarns produced.

FIG. 6 illustrates a system similar to FIG. 5 but also provided with means for joining together spaced locations on two plied yarns preparatory to cabling thereof.

FIG. 7 is a transverse sectional view of a device for twisting and interconnecting two strands positioned therein.

FIGS. 8 and 9, respectively, are side elevation and front views of another embodiment of the invention for forming plied yarns and cabling such yarns together.

FIG. 10 shows a further embodiment for producing a yarn with unequal spacing between the points of twist reversal.

FIGS. 11 and 12 show two stages in the production of a yarn which is especially constructed to minimize untwisting when tensioned.

FIG. 13 illustrates a system for strengthening strands of low tensile strength for use in connection with the invention.

FIG. 14 shows another embodiment of the invention; and,

FIG. 15 is a transverse sectional view of a device which may be used in the apparatus of FIG. 14.

FIGS. 16 and 17 are diagrammatic views showing a preferred mode of operation of the FIG. 14 apparatus.

FIG. 18 is a transverse sectional view of a modified strand twisting device which also includes a strand clamping element; and, FIG. 19 is a diagrammatic view showing a system which utilizes the FIG. 18 devices.

BRIEF DESCRIPTION OF PREFERRED EMBODIMENTS

The basic principle of the invention is shown in FIG. 1 where strand twisting devices 2 and strand joining devices 4 are mounted on the periphery of a wheel 6 which is rotated about axis 8 by a drive motor. A strand B is fed to the wheel by pull rolls 10, the surface velocity of which is less than but substantially the same as the velocity of the strand-receiving twisters 2 and joiners 4. The twisting devices 2 may be arranged to insert either twist of the same direction or twist of the opposite directions in the sections 12 and 14 of strand B. The lowermost twisting devices 2 will simultaneously insert equal twists into sections 14 and 16. At the illustrated position, section 17 of the strand may not have received its full quota of twist, but more twist will be added to this section when the uppermost twister 2 passes to a position where it receives and engages the strand from pull rolls 10.

The wheel assembly actually processes two strands A and B as shown in FIG. 2, both of these strands being guided into the joiners 4 which connect them together. These strands are guided individually into the twisters 2 which provide them with the alternating twist required for self-twisting.

An assembly of two twisters 2 is shown in FIG. 3 wherein cylindrical bores 18 for the strands are provided in a common block. Longitudinal strand threading slots 20 communicate with the bores 18 and provide a passage whereby appropriately guided strands may move laterally into and out of the twister bores 18. Passages 22 continuously or intermittently introduce tangential steams of air into the bores 18, forming vortices which rotate the strands about their respective axes to insert twist upstream and downstream of the twister 2. It has been found that the strands do not rotate about the central axis of the bore 18 but assume a roughly circular path about such axis, causing a vibrational motion of the yarn which assists promulgation of twist along the strands when they are in contact with a surface. The portion of the strand inside bore 18 is an untwisted short length referred to as a node, and the twist produced in the strands inherently has an opposite direction on opposite sides of each twister. This twister is easily threaded through slot 20 and, since the strand always rotates the same direction in the bore 18, the slot 20 may be inclined relative to the bore radius and inclined relative to the bore axis.

A strand joining device 4 is shown in FIG. 4. It includes a block with a longitudinal cylindrical bore 24 which receives and discharges both strands A and B through a longitudinal threading slot 26. Air or other fluid is introduced into the bore 24 through a passage 28 which is directed at the center of the bore, thereby creating an area of turbulence which will interconnect the strands by entangling their fibers. When joining is effected, any twist added to one of the joined strands cannot propagate beyond the joined position. Auxiliary clamps may be associated with the device 4 to hold the strands and/or the joining therebetween against rotation.

After passing around the wheel the strands A and B pass around takeoff roller 30 and may either be forcibly plied or allowed to ply by release of the torque stored therein. The latter type of plying is caused by the torque induced by the twist in the single strands which, being joined at intervals, are not in a torque balance until they have rotated around each other. This reduces the single strand twist torque but creates a ply strand twist torque which balances it at some level of ply torque, as has been fully explained in the prior art.

FIG. 2 illustrates diagrammatically the twist pattern produced by wheel 6 in an idealized case where the strand joinings do not rotate on the wheel. In practice, such rotation may occur unless the nodes are clamped or a rotation preventing barrier is placed between the two strands. In FIG. 2, the connections produced by the joiners 4 are designated 32 and unjoined twist reversal nodes from the twisters 2 are designated 34. The distances between points 32 and 34 are a function of the spacings between the twisters 2 and joiners 4 along the circumference of the wheel 6.

The twist on opposite sides of twist insertion points 34 must be different, but the twist on opposite sides of the points joined by joiners 4 may be the same or different depending on the twist direction of successive twisters 2 on the wheel 6. In FIG. 2, transverse arrows indicate that the twisters 2 rotate their respective strands in opposite directions, providing unidirectional twist which extends throughout the length between the twist insertion points 34. If all twisters 2 were to rotate their respective strands in the same rotational direction, the unidirectional twist zones would have half the length shown in FIG. 2. A product formed as shown in FIG. 2 is preferred, especially if the joiners 4 produce a very short twist discontinuity since this will be almost unnoticeable when the strands have been plied. This provides a much greater length of unidirectional twist in a self twist yarn than prior methods.

When a self twist yarn is allowed to ply freely, there is inherently some remaining singles twist, resulting from the balance between ply twist torque and the opposed direction single twist torque. However, for carpets and other commercial applications, the singles twist actually remaining in the plied yarn is required to be low or zero. To meet such requirements, the plied yarn may be further twisted to increase the ply twist and reduce the singles twist, held in an unstable torque condition and heat set to destroy the excess ply twist torque and stabilize the low singles twist configuration. This may be accomplished by cabling a pair of plied yarns together, with appropriately located points of twist reversal, heat setting the cabled structure and then pulling the cabled structure apart into plied yarns which then possess the appropriate twist. This technique is the subject of U.S. patent application Ser. No. 906,483 filed May 27, 1978, which is incorporated herein by reference.

FIG. 5 shows a continuous system for forming singles yarns into plied yarns, and for cabling the plied yarns together in preparation for a heat-setting step. This involves a wheel 6, constructed and operated as described in connection with FIG. 1, and a cabling wheel 36 which carries yarn twisting devices 38 constructed similarly to the twisters 2. Roll 40 feeds the plied yarns to the twisters 38 which are spaced apart so as to come into alignment and engagement with the twist reversal nodes of the two-ply yarns. The twist direction of twisters 38 is oriented to increase the ply twist and reduce the singles twist on both sides of the point of twist insertion. The cabled strand produced by this apparatus would contain at least four singles strands, plied in pairs in section 31 to form two two-ply yarns which are plied to each other. This spacing is similar to circumferential spacing between the twisters 2, but is less due to the longitudinal contraction produced by plying. In the FIG. 5 apparatus, the yarn plies between the rolls 30 and 40 which are preferably spaced apart a distance of 0.7 of the twist cycle length. There are, of course, two side-by-side pairs of twisters 38 on wheel 36, each pair being operable on one of the plied yarns fed thereto.

The yarns pass over takeoff roll 42 and they are brought together so they may entwine and cable in section 44. Then, they normally pass to heat setting or packaging.

If it is desired to join the plied yarns at the cable twist nodes, this may be achieved by the structure of FIG. 6 which is identical to FIG. 5 but further includes a third wheel 46 which carries node-joining means 48 similar to those shown in FIG. 2. These joiners 48 would be timed to coincide with the positions of the twist reversal nodes in the cabled strand. In this case, the elements are spaced and constructed in a manner which will prevent the cabling self-twisting from occurring until the excess-twisted plied yarns leave the wheel 46.

Rather than using two different wheels 36 and 46 for twisting and joining the plied yarns, it may be possible to use a single such wheel provided with devices capable of performing both twisting and joining functions. Such a device, shown at 50 in FIG. 7, is similar to the twister 2 except that the position of the fluid inlet jet 52 has been shifted closer to the center of the strand-receiving bore 54. It is believed that this will twist and entangle filaments in bore 54. If such devices were installed on wheel 36, the yarn 32 leaving the wheel would have received additional ply twist and would have its nodes joined. Self-twist cabling, heat setting and splitting, would then produce a stable ply yarn with joined nodes.

FIGS. 8 and 9 show a system in which a single wheel performs the functions of three wheels of FIG. 8, reducing the cost of the apparatus and avoiding potential phasing problems. In this embodiment a wheel 56 has outer sections 58 and 60, and an inner section 62. Both outer sections 58 and 60 are constructed and operate similarly to the wheel 6, receiving singles strands and giving them an alternate twist structure so they will self-twist together when brought together after leaving the wheel. The alternately twisted strands are lifted from wheel sections 58 and 60 by a guide roller assembly 64 which has three independently rotatable, flanged guide rollers. These rollers guide the yarn from and to the respective sections of the wheel 56. Four strands from pull rolls 66 are guided on wheel 56 so each strand enters a twister 2 and each pair of strands enters joining means 4, substantially as in the embodiment of FIG. 1. Alter almost a complete revolution of the wheel 56, the strands have an alternate twist and are lifted from sections 58 and 60 by roller assembly 64 and guided back into twister-joiner devices 50 on the inner section 62 of the wheel 56. The devices 50 have been previously described in connection with FIG. 7. The inner section 62 has a smaller circumference than sections 58 and 60 to allow for the longitudinal contraction produced in the yarn by twisting. The strands pass almost a complete revolution on section 62 of the wheel 56 where they are given additional ply turns and are joined at the ply yarn nodes. The plied yarns are lifted from section 62 by the guide 64 and they entwine a short distance therefrom to form a cabled yarn structure.

This invention makes it possible to make yarns in which the distances between twist reversal nodes are unequal, so that the longitudinally successive lengths of unidirectional twist are not equal. A system for producing such yarns is shown in FIG. 10 where the wheel 67 has twisters 2 which are not equally spaced from or symmetrically arranged with respect to the joiners 4. In the yarn produced, the node locations are designated 68 and the twist directions are shown by the letters S and Z.

It is possible for the two twisters 2 in FIG. 10 to insert different twist levels, and this would be reflected in the yarn, providing an unusual yarn with varying twist levels in varying length sections.

The invention also makes it possible to produce a self twisted yarn formed of side-by-side strands which have unequal lengths between their interconnected twist reversal nodes. In such yarns, the strands do not equally bear any tensile forces so as to reduce their tendency to untwist which occurs when they are tensioned.

The undesirable behavior of conventional self twist yarns under tension is well known. When such yarns are tensioned, the node will rotate in a direction which is opposite to the direction which the node of the singles yarn would tend to rotate if it were not plied with another such singles yarn. It is possible to reduce this tension-produced untwisting of the self-twisted yarn by ensuring that the tension therein is carried unequally to the single yarns. Such an effect may be realized by making one singles yarn a little shorter than the other singles yarn in the plied yarn.

Such a plied yarn may be made as shown in FIG. 11 where, between successive interconnections 70, the strands D and E have the same direction of twist but unequal length. The strands may have equal length when measured between alternate interconnections. It is apparent that when such strands ply, the shorter strand will assume a position closer to the yarn axis than the longer strand. Thus, when the strands in FIG. 11 are released, they ply to form a yarn as shown in FIG. 12. A slightly non-uniform yarn results in which the longer yarn is wrapped more about the shorter yarn then vice versa. Such a yarn when tensioned has an unwinding torque from the self-twisted yarn tending to twist the nodes 70 in one direction and an unwinding torque from the singles strands therein tending to turn the node in the opposite direction. This greatly reduces tension and reduces loss of twist from the yarn.

The apparatus described above is primarily for use in processing continuous filament strands or staple fiber strands such as plied yarns which have sufficient tensile strength to withstand the attendant handling. Carded sliver formed of fibers approximately 7½ inch long may also be processed in such apparatus, particularly if the distances between the successive twisters on the wheels are reduced proportionately. For staple fiber processing, the distance between rolls 13 and 14 is minimized.

Unless special precautions are taken, the systems described above do not lend themselves to the production of yarns from low strength sliver such as carded sliver formed of short fibers. This is because the staple fiber length of such sliver may be less than the untwisted length of sliver between the pull rolls 10 and the wheel 6 of FIG. 1. In a high speed process, the change in direction would create a tension which is greater than fiber cohesivity, resulting in strand breakage.

In order to use this invention for processing low strength strands, it may be necessary to strengthen the strands, modify the system to reduce the distance between the elements which act on the strands, or modify the system to reduce the amount of tension to which the strands are subjected. Strengthening of staple fiber strands may be achieved by combining them with a strong continuous filament component, by entangling their fibers to increase cohesivity or by twisting the strands in the sections where they are most vulnerable to tension breakage. Regarding the first-mentioned technique, it is possible to introduce a continuous filament between rolls 10 in FIG. 1, and to spin the filament into the staple yarn produced. This procedure, known as core spinning, is known and is used in thread production on ring spinning machines.

FIG. 13 illustrates a strand strengthening measure which twists the strand in the area where it is most vulnerable. A staple fiber sliver 72 is engaged by pull rolls 74 which may be the front rolls of a conventional drafting system. The sliver at 76 has the desired final weight per unit length and it is given real twist by a fluid vortex twister 78. After the process has run a short time, little if any twist remains in the downstream portion 80 of the sliver, but upstream portion 76 is in a twisted and stronger state. The substantially untwisted sliver portion 80 is fed to a device 84, which increases the tensile strength of the strand by adhering the fibers together or by entangling them by fluid turbulence. From device 84, the strengthened sliver enters rolls 74 and passes to the wheel 85.

FIG. 14 depicts a system which strengthens the unsupported strand with an intermittently operated unidirectional fluid vortex twister 86.

When twister 86 has been operating, Z turns are in the upstream strand length 88 and few, if any, S turns are in the downstream length 90. The twister 86 is momentarily deactivated, enabling the strand with Z turns to pass to 90 and the twist to become distributed over lengths 88 and 90. Real Z twist would be taken onto the wheel 6. Reactivation of the twister 86 would produce more Z turns in length 88, while more S turns would appear in length 90 and be taken onto wheel 93. The periodicity of the twister 86 may be timed with the positions of twisters 92 on the wheel 93 to give a regular or irregular small change in total strand twist before plying. This may also be used to produce an irregular yarn. The twister 86 is preferably constructed to release air in the general direction of strand movement, thereby alleviating the tension in the downstream length 90. This air release pattern may be achieved by adjusting the bores at the entry and exit of twister 86, by angling the twister jet in a downstream direction, or both.

The FIG. 14 apparatus, in addition to strengthening the unsupported strand section, shortens the distances between the twist insertion points while still producing a product with relatively long distances between the twist reversal nodes. The latter capability is attributable in part to the multifunctional device 92 shown in FIG. 15. It is capable of twisting a strand in either direction, joining adjacent strands by entangling their fibers, or clamping a strand to hold it against rotation. It includes jets 94, 96 and 98 fed by pressurized fluid and controlled to operate in a sequence which is appropriate to the selected purpose of the apparatus. Jets 94 and 98 rotate a strand in opposite directions. Jet bore 96 produces entanglement similarly to the FIG. 4 device. The clamp 100 is moved by an electrical, fluid or mechanical actuator from the retracted position shown in solid lines to the clamping position shown in broken lines. Jet bores 94, 96, 98 and clamp 100 are shown lying in the same plane for simplicity of illustration, but it is not essential that they be so disposed.

The system of FIG. 14 includes the wheel 93 which carries devices 92 spaced apart by relatively short distances so that short fiber sliver may be processed. Such shorter distances reduce the length of twist zones in the strands and would normally increase the frequency of the nodes in the yarn produced, but in this case the devices 92 are operated so as to reduce the length between twist reversal nodes without increasing the length of unsupported strand sections. As shown schematically in FIGS. 16 and 17, the spacing between the devices 92 is adequate to allow individual fibers in the short fiber sliver F to bridge tensioned lengths between successive device 92 so the area of one twist will extend from F1 to F3 and the area of opposite twist extends from F3 to F5.

The first strand twist configuration produced on wheel 85 is shown in FIG. 16. Successive devices 92 are operated as twisters in opposite directions as shown by the transverse arrows so the twist between them is in the same direction. Subsequently, the devices are simultaneously or sequentially changed to the modes shown in FIG. 17, wherein the letters C show that the twisters at F1, F2, F4 and F5 clamp the strand to prevent rotation. The device at F3 reverses so the area of one twist extends from F1 to F3 and the area of opposite twist extends from F3 to F5. It is apparent in FIG. 16 that there is little tension on the strand and in any event it is clamped at intervals for support. The clamps are released to allow the strand F to leave the wheel 16 for plying, preferably with a similarly processed identical strand.

To prevent the partial untwisting of a strand after it is alternately twisted and before it self-twists to the adjacent strand, it is desirable to place the twisting jets as closely together as possible and to clamp the strands to hold them against any untwisting rotation.

This is a purpose of the system shown in FIGS. 17 and 18 wherein twisters 102 are alternately disposed around the wheel. As shown in FIG. 17, each twister 102 is provided with an external spring clip 104 which clamps the adjacent strand to hold it against rotation. A rivet 106 attaches the spring clip 104 to the external surface of the twister 102.

FIG. 19 shows the alternately disposed twisters 102 moving at the speed of the engaged strands G and H. The twisters acting on strand G all act in one direction and the twisters acting on strand H all act in the opposite direction. Between each pair of twisters, each strand is clamped against rotation so an opposite twist direction will exist on opposite sides of the clamped location. Strand G is clamped at G3 between twist insertion points G1 and G2; and, strand H is clamped at H3 between points H1 and H2. Each point where strand G is clamped is adjacent to a twist insertion point in strand H, and vice versa. The twists in strands G and H are such that when brought together, they will self-twist together. Preferably, their twist nodes are interconnected before self-twisting by using devices such as joining devices shown in FIG. 4 or the devices 50 or 92.

In general, it is desirable to make the twister-carrying wheels as large as practical for the particular installation, and to provide such wheels with a large number of twisting, joining or clamping devices. This enhances the ability of the twisting devices to propagate twist around the wheel circumference and will increase the time period during which the twisters and joiners act on the strand. Increased residence time allows reduced fluid pressures for a given production speed, and it enables the twist to become distributed more uniformly. Ideally, the twisters should be given a single pulse of high pressure shortly after engaging the strand, and the pressure thereafter is maintained at a maintenance level thereafter to prevent untwisting of the strand on the wheel.

Persons skilled in the art will realize that the embodiments disclosed herein are capable of a myriad of modifications to provide methods and products which were heretofore unattainable. One promising application of the invention is for cabling yarns which have been plied according to the Chambley and Norris U.S. Pat. No. 4,074,511, thereby avoiding any risk that the yarn structure will be disrupted by relative movement through a stationary twisting device.

It will also be appreciated that the twisters, joiners and clamps may be controlled by timing and valving mechanisms to change the sequence in which operations are performed on the strand. For example, preparatory to self twisting, two strands may be joined together at spaced points before twist is inserted into each of the strands at an intermediate point to provide the alternate twist structure. The twist insertion points may then be joined before or simultaneously with self-twisting, with or without the insertion of additional ply twist.

A wide variety of strand interconnecting devices and techniques may be used. For continuous filaments, such devices may be constructed and operated according to the disclosures of U.S. patent application Ser. No. 891,068, filed Mar. 29, 1978, now U.S. Pat. No. 4,170,103, or U.S. patent application Ser. No. 968,501, filed Dec. 11, 1978, now abandoned, which are incorporated hereby by reference. Staple fiber strands may be interconnected by devices such as those shown in U.S. Pat. Nos. 4,074,511, 4,142,355 and U.S. application Ser. No. 850,690 filed Nov. 11, 1977, now U.S. Pat. No. 4,173,861, which are incorporated herein by reference. Various known electrical and adhesiveapplying means may also be used.

From the foregoing, it will be seen that this invention is capable of widespread adaptation to various self-twist yarn processing situations. Therefore, it is emphasized that the invention is not limited to the disclosed embodiments but is embracing of modifications and improvements thereto which fall within the spirit of the following claims.

I claim:

1. A method of twisting a textile strand to provide longitudinally spaced zones which are twisted in opposite directions, comprising the steps of moving the strand in a longitudinal direction, moving a first strand twisting device concurrently with the strand and operatively engaging a first location on the strand with said first strand twisting device, rotating the strand with said first strand twisting device to provide the strand with opposite twists on opposite sides of the first location, bringing the twisted strand into parallel adjacent relationship with a second strand, and releasing the twisted strand to permit it to untwist at least partially and to twist itself to said second strand.

2. The method of claim 1 including the steps of moving a second strand twisting device concurrently with the strand, operatively engaging a second location on the strand with said second strand twisting device, said second location being spaced from the first location, and rotating the strand at said second location with said second strand twisting device.

3. The method of claim 2 including the steps of holding the strand against rotation at a third location between the first and second locations, said rotating steps twisting the strand in a same direction at both said first and second locations whereby the strand will have opposite twists on opposite sides of said third location.

4. The method of claim 3 wherein the strand is held against rotation by joining it at said third location to said second strand.

5. The method of claim 3 wherein the strand is held against rotation at the third location by engaging it with a strand-clamping means.

6. The method of claim 5 wherein the second strand is subjected to the same steps as the first strand, said third location of said second strand being located adjacent to one of the first or second locations of said first strand.

7. The method of claim 1 including the step of moving a second strand twisting device concurrently with the strand, operatively engaging a second location on the strand with said second strand twisting device, said second location being spaced from the first location, moving a third strand twisting device concurrently with the strand, operatively engaging a third location on the strand with said third strand twisting device, said second location being located between said first and third locations on the strand, rotating the strand with said first and third strand twisting devices at said first and third locations in one direction and rotating the strand with said second strand twisting device at said second location in an opposite direction whereby the strand is twisted in one direction between the first and second locations and is twisted in an opposite direction between the second and third locations.

8. The method of claim 7 wherein the distance between said first and second locations is different from the distance between said second and third locations whereby the length of said strand twisted in one direction is different from the length of said strand twisted in the opposite direction.

9. The method of claim 7 including the steps of moving fourth and fifth strand twisting devices concurrently with the strand and operatively engaging fourth and fifth locations on the strand respectively with said fourth and fifth strand twisting device, said fourth location being located between said third and fifth locations, said method being performed by rotating the strand at the first and fifth locations in one direction while rotating the strand at the second and fourth locations in an opposite direction, holding the strands against rotation at the first, second, fourth and fifth locations and, while the strand is so held, rotating the strand with the third strand twisting device at the third location in said opposite direction whereby the strand is twisted in one direction between the first and second third locations and twisted in an opposite direction between the third and fifth locations.

10. The method of claim 1 wherein the twisting of the twisted strand to the second strand forms a plied yarn, including the further method of cabling and plied yarn to another plied yarn, said method including the steps of moving a first yarn twisting device concurrently with the plied yarn and operatively engaging a first point on the yarn with said first yarn twisting device, rotating the yarn at said first point to provide the yarn with opposite twists on opposite sides of said point, bringing the twisted yarn into parallel adjacent relationship with a second yarn, and releasing the twisted yarn to permit it to untwist at least partially and to twist itself to said second yarn to form a cabled yarn.

11. The method of claim 10 wherein the strand twisting devices and the yarn twisting devices are moved in circular paths, said method including the steps of removing the strands from the circular path of the strand twisting devices and feeding the yarn to the path of said yarn twisting devices.

12. The method of claim 11 wherein the centers of said circular paths are spaced from each other.

13. The method of claim 11 wherein said circular paths are concentric.

14. The method of claim 1 wherein the strand twisting device is moved in a circular path.

15. The method of claim 1 wherein the strand and said first strand twisting device move laterally relative to each other until said strand is operatively engaged by said first strand twisting device.

16. The method of claim 15 including the step of moving two strands laterally into a longitudinal bore of a strand-joining device, and joining the strands to each other by producing fluid turbulence in said bore to entangle the fibers of said strands.

17. The method of claim 16 including the step of holding said strand against rotation in said bore.

18. The method of claim 15 wherein said rotating step is performed by admitting fluid into a tangential inlet of a longitudinal strand-receiving bore, said relative lateral movement moving the strand through a slot which enters the said bore.

19. The method of claim 1 including the step of joining spaced locations on the strand to spaced locations on a second strand before releasing the twisted strand to permit it to twist itself to said second strand.

20. The method of claim 19 wherein the length of said first strand between a pair of said spaced locations is different from the length of said second strand between said pair of spaced locations.

21. The product produced by the method of claim 20.

22. The method of claim 1 wherein the rotating step twists a length of strand forwardly of the strand twisting device which has a length different from the length of strand twisted rearwardly of said strand twisting device.

23. The product produced by the method of claim 22.

24. The method of claim 1 including the step of moving the strand through a stationary fluid jet twister before engaging the strand with the first strand twisting device.

25. The method of claim 1 including the step of introducing into the strand a continuous thinner strand of greater tensile strength.

26. The method of claim 1 including the step of moving a strand holding device concurrently with the strand, engaging the strand with the strand holding device to hold the strand against rotation at the strand holding device, moving a strand joining device concurrently with the strand, engaging the strand with the strand joining device and joining the strand to the second strand at the strand joining device.

27. The method of claim 1 including the step of moving a strand holding device concurrently with the strand, and engaging the strand with the strand holding device to hold the strand against rotation at the strand holding device.

28. The method of claim 1 including the step of moving a strand joining device concurrently with the strand, engaging the strand with the strand joining device and joining the strand to the second strand at the strand joining device.

29. The method of claim 1 wherein the strand is a continuous bundle of filaments.

30. The method of claim 1 wherein the strand is an assembly in continuous form of discontinuous filaments.

31. The method of claim 1 wherein the strand is a drafted carded sliver made from fibers pretreated to increase its tensile strength.

32. The method of claim 1 wherein the strand is a drafted carded sliver.

33. The method of claim 1 wherein the strand is produced by a tow treatment process.

34. The method of claim 1 wherein the strand is a combination of staple fibers and one or more continuous filaments.

35. The method of claim 1 wherein the strand subjected to the method is a component of a plied yarn.

36. Apparatus for twisting a textile strand to provide longitudinally spaced zones which are twisted in opposite directions, comprising means for moving the strand in a longitudinal direction, means for moving a first strand twisting device concurrently with the strand and into operative engagement with a first location on the strand, said first strand twisting device including means for rotating the strand at the first location to provide the strand with opposite twists on opposite sides of the first location, means for bringing the twisted strand into parallel adjacent relationship with a second strand and releasing the twisted strand to permit it to untwist at least partially to twist itself to said second strand.

37. The apparatus of claim 36 including a second strand twisting device spaced from the first strand twisting device, means for moving said second strand twisting device concurrently with the strand into operative engagement with a second location on the strand, said second strand twisting device including means for rotating the strand at the second location to provide the strand with opposite twists on opposite sides of said second location.

38. The apparatus of claim 37 including means for holding the strand against rotation at a third location between the first and second twisting devices, said twisting devices rotating the strand in a same direction at both said first and second locations whereby the strand will have opposite twists on opposite sides of said third location.

39. The apparatus of claim 38 wherein the means for holding the strand against rotation includes means for joining it at said third location to said second strand.

40. The apparatus of claim 38 wherein the means for holding the strand against rotation is a strand-clamping means.

41. The apparatus of claim 40 having third and fourth strand twisting devices for rotating the second strand at spaced locations thereon to provide the second strand with opposite twists on opposite sides of the locations where twist is introduced, a second strand clamping means for holding said second strand against rotation at a location between the third and fourth strand twisting devices, said third and fourth strand twisting devices rotating the second strand in a same direction at their respective locations, said second strand-clamping means being located adjacent to one of the first or second strand twisting devices.

42. The apparatus of claim 36 including a second strand twisting device spaced from the first strand twisting device, means for moving the second strand twisting device concurrently with the strand into operative engagement with a second location on the strand, said second strand twisting device including means for rotating the strand at the second location to provide the strand with opposite twists on opposite sides of said second location, a third strand twisting device spaced from the first and second strand twisting devices, means for moving the third strand twisting device concurrently with the strand into operative engagement with a third location on the strand, said third strand twisting device including means for rotating the strand at the third location to provide the strand with opposite twists on opposite sides of the third location, said second strand twisting device being located between the first and third strand twisting devices, said twisting means of said first and third strand twisting devices being arranged to rotate the first and third locations in one direction which is opposite to the direction of rotation applied to the second location by the second strand twisting device, whereby the strand is twisted in one direction between the first and second locations and is twisted in an opposite direction between the second and third locations.

43. The apparatus of claim 42 wherein the distance between said first and second strand twisting device is different from the distance between said second and third strand twisting devices whereby the length of said strand twisted in one direction is different from the length of said strand twisted in the opposite directions.

44. The apparatus of claim 42 including spaced apart fourth and fifth strand twisting devices, means for moving said fourth and fifth strand twisting devices concurrently with the strand into operative engagement with the fourth and fifth locations of the strand, said fourth strand twisting device being located between said third and fifth strand twisting devices, said twisting means being arranged initially to rotate the strand at the first and fifth locations in one direction while rotating the strand at the second and fourth locations in an opposite direction, means operable subsequently to hold the strands against rotation at the first, second, fourth and fifth locations while said twisting means of the third strand twisting device rotates the strand in said opposite direction whereby the strand becomes twisted in one direction between the first and third locations and twisted in an opposite direction between the third and fifth locations.

45. The apparatus of claim 36 wherein the twisting of the twisted strand to the second strand forms a plied yarn, including apparatus for cabling the plied yarn to another plied yarn, said apparatus including a first yarn twisting device, means for moving said first yarn twisting device concurrently with the plied yarn and into operative engagement with a first point on the yarn, said yarn twisting device including means for rotating the yarn at said first point to provide the yarn with opposite twists on opposite sides of said first point, means for bringing the twisted yarn into parallel adjacent relationship with a second yarn and releasing the twisted yarn to permit it to untwist at least partially and to twist itself to said second yarn.

46. The apparatus of claim 45 wherein the moving means moves the strand twisting devices and the yarn twisting devices in circular paths, means for removing the strands from the circular path of the strand twisting devices and feeding the yarn to the path of said yarn twisting devices.

47. The apparatus of claim 46 wherein the centers of said circular paths are spaced from each other.

48. The apparatus of claim 46 wherein said circular paths are concentric.

49. The apparatus of claim 36 wherein the moving means moves the strand twisting device in a circular path.

50. The apparatus of claim 36 wherein the moving means move the strand and said first strand twisting device laterally relative to each other until said strand is operatively engaged by said first strand twisting device.

51. The apparatus of claim 50 including a strand-joining device, means for moving two strands laterally into a longitudinal bore of the strand-joining device, and means in the strand-joining device for producing fluid turbulence in said bore to join the strands by entangling their fibers.

52. The apparatus of claim 51 including means for holding said strand against rotation in said bore.

53. The apparatus of claim 50 wherein said twisting means includes a longitudinal strand-receiving bore, a slot leading into said bore for admitting a strand into the bore, and means for admitting fluid into a tangential inlet of said bore.

54. The apparatus of claim 36 including means for joining spaced locations on the strand to spaced locations on the second strand before the strand twists itself to the second strand.

55. The apparatus of claim 54 including means for providing a length of said first strand between a pair of said spaced locations, and means for providing a greater length of said second strand between said pair of spaced locations.

56. The apparatus of claim 36 including means for providing a unidirectionally twisted length of strand forwardly of the strand twisting device which has a length different from the unidirectionally twisted length of strand disposed rearwardly of said strand twisting device.

57. The apparatus of claim 36 including stationary fluid jet twister means for twisting the strand before the strand is engaged with the first strand twisting device.

58. The apparatus of claim 36 including a strand holding device, means for moving the strand holding device concurrently with the strand and into engagement with the strand, said strand holding device including means for holding the strand against rotation, a strand joining device, means for moving the strand joining device concurrently with the strand and into engagement with the strand, said strand joining device including means for joining the strand to the second strand at the strand joining device.

59. The apparatus of claim 36 including a strand holding device, means for moving the strand holding device concurrently with the strand and into engagement with the strand, said strand holding device including means for holding the strand against rotation at the strand holding device.

60. The apparatus of claim 36 including a strand joining device, means for moving the strand joining device concurrently with the strand and into engagement with the strand, said strand joining device including means for joining the strand to the second strand at the strand joining device.

* * * * *